US005368449A

United States Patent [19]

Kimura et al.

[11] Patent Number: 5,368,449

[45] Date of Patent: Nov. 29, 1994

[54] REFRIGERANT GAS GUIDING MECHANISM FOR PISTON TYPE COMPRESSOR

[75] Inventors: Kazuya Kimura; Hiroaki Kayukawa; Masafumi Ito; Chuichi Kawamura; Shigeyuki Hidaka; Yoshihiro Fujisawa, all of Kariya, Japan

[73] Assignee: Kabushiki Kaisha Toyoda Jidoshokki Seisakusho, Kariya, Japan

[21] Appl. No.: 98,332

[22] PCT Filed: Dec. 22, 1992

[86] PCT No.: PCT/JP92/01679

§ 371 Date: Aug. 2, 1993

§ 102(e) Date: Aug. 2, 1993

[87] PCT Pub. No.: WO93/13313

PCT Pub. Date: Jul. 8, 1993

[30] Foreign Application Priority Data

Dec. 24, 1991 [JP] Japan ..... 3-341217
Feb. 20, 1992 [JP] Japan ..... 4-033645

[51] Int. Cl.[5] ..... F04F 27/08
[52] U.S. Cl. ..... 417/269; 417/516
[58] Field of Search ..... 417/269, 516

[56] References Cited

U.S. PATENT DOCUMENTS 2,248,449 7/1941 Dudley ..... 417/519
2,835,436 5/1958 Steinhagen ..... 417/269
4,007,663 7/1977 Nagatomo ..... 417/269 X
5,109,754 5/1992 Shaw ..... 417/269 X

*Primary Examiner*—Richard E. Gluck
*Attorney, Agent, or Firm*—Brooks Haidt Haffner & Delahunty

[57] ABSTRACT

A plurality of pistons are provided in the associated cylinder bores arranged around the rotary shaft. Each piston reciprocates in relation to the rotation of the rotary shaft to execute suction, compression and discharge of the refrigerant gas. A valve chamber is disposed in the vicinity of the cylinder bore. A plurality of ports are arranged to communicate the valve chamber to the associated cylinder bores. The valve chamber has a rotary valve which rotates in relation to the reciprocating motion of the pistons. A suction passage is formed in the rotary valve to be sequentially communicated with each port in synchronism with the rotation of the rotary valve in order to introduce the refrigerant gas into each cylinder bore. A seal zone is included in the rotary valve, which sequentially blocks each port in synchronism with the rotation of the rotary valve. A groove is defined in the rotary valve, which is capable of guiding the refrigerant gas entering between the valve chamber and the rotary valve.

9 Claims, 7 Drawing Sheets

REFRIGERANT GAS GUIDING MECHANISM FOR PISTON TYPE COMPRESSOR

TECHNICAL FIELD

The present invention relates to a refrigerant gas guiding mechanism for a piston type compressor.

BACKGROUND ART

In general, a piston type compressor is equipped with a plurality of pistons, each of which reciprocates in accordance with the rotation of a rotary shaft. With the reciprocatory motion, refrigerant gas is sucked into a compressor and discharged outward after having compressed within the compressor.

Conventionally, a piston type compressor of this kind, as shown in FIG. 10, has a housing 52 in which a suction chamber 50 and a discharge chamber 51 are defined. A cylinder bore 53 is formed in a cylinder block 54. A valve plate 55 has a suction port 55*a* and a discharge port 55*b* formed therein. A suction plate 56 and a discharge plate 57 have a suction valve 56*a* and a discharge valve 57*a*, respectively. The valve plate 55 is disposed between the cylinder block 54 and the housing 52. The suction plate 56 and the discharge plate 57 are located on opposing sides of the valve plate 55.

As a rotary shaft 60 rotates, with a piston 58 moving leftward, as illustrated in FIG. 10, the suction valve 56*a* is elastically deformed to open the suction port 55*a*, in order to allow the refrigerant gas in the suction chamber 50 to be sucked, via the suction port 55*a*, into a working chamber 59 in the associated cylinder bore 53. When the piston 58 shifts rightward after the suction operation is completed, the suction valve 56*a* closes the suction port 55*a*. Thereafter, when the pressure in the working chamber 59 rises to, or above a predetermined level, the discharge valve 57*a* elastically deforms to open the discharge port 55*b*, in order to discharge the compressed refrigerant gas from the working chamber 59 into the discharge chamber 51, via the discharge port 55*b*.

A lubricant oil is generally mixed with the refrigerant gas, which will stick on the suction valve 56*a*, etc. Consequently, when the suction valve 56*a* elastically deforms to open the suction port 55*a*, the oil might cause the suction valve 56*a* to adhere to the suction port 55*a*, thus adversely affecting the suction response.

The suction valve is designed to open the suction port against the elasticity of the valve in accordance with a change in the suction pressure of the refrigerant gas. This design requires that the pressure of the refrigerant gas be raised above the elastic force of the suction valve, thus resulting in an increase of the pressure loss in the compressor.

In addition, since the suction chamber adjoins the discharge chamber, the heat of the gas with a high temperature within the discharge chamber expands the refrigerant gas in the suction chamber. Decrease in density of the refrigerant gas before entering the working chamber leads to substantial drop in compression volume in the working chamber to cause volumetric efficiency of the compression to be reduced.

Accordingly, the present invention has been accomplished with a view to overcoming the above-described problems, and it is an object of the invention to provide a refrigerant gas guiding mechanism for a piston type compressor with an efficient sealing, which can suppress the pressure loss resulting from the structure of the suction valve, and improve volumetric efficiency.

DISCLOSURE OF THE INVENTION

A plurality of pistons, in the compressor according to the invention, are provided in associated cylinder bores arranged around the rotary shaft. Each of the pistons reciprocates in relation to the rotation of the rotary shaft to execute suction, compression and discharge of the refrigerant gas. A valve chamber is disposed in the vicinity of the cylinder bore. A plurality of ports are arranged to communicate the valve chamber to the associated cylinder bores. The valve chamber has a rotary valve which rotates in relation to the reciprocating motion of the pistons. In the rotary valve is there formed a suction passage to be sequentially communicated with each of the ports in synchronism with the rotation of the rotary valve in order to introduce the refrigerant gas into each of the cylinder bores. In the rotary valve is there included a seal zone which sequentially blocks each of the ports in synchronism with the rotation of the rotary valve. Furthermore, in the rotary valve is there defined a groove capable of guiding the refrigerant gas entering between the valve chamber and the rotary valve.

DESCRIPTION OF THE PREFERRED EMBODIMENTS

Figure 1:
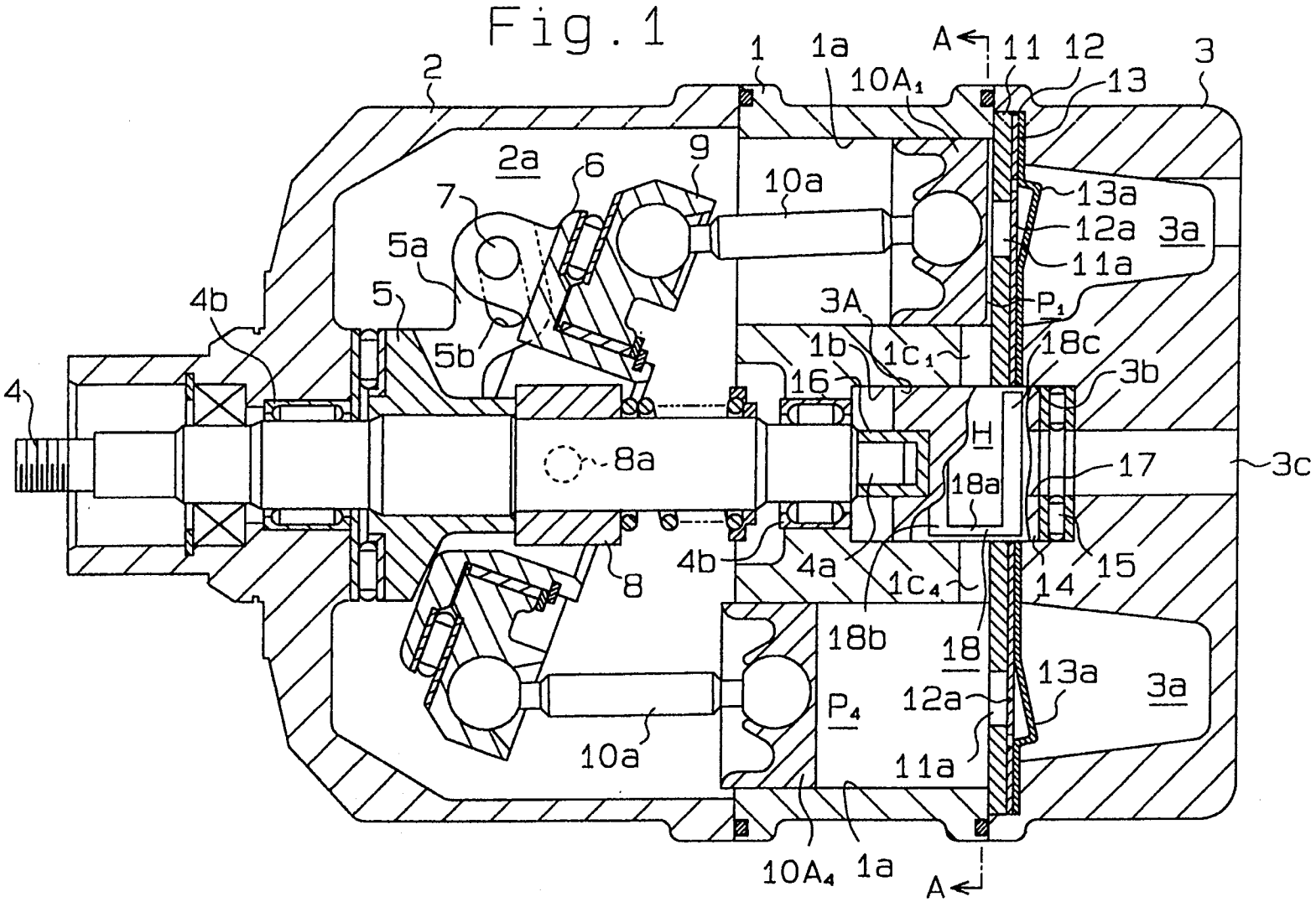
FIG. 1 is a sectional side view of a whole compressor according to a first embodiment of the present invention.

A first embodiment of the present invention as applied to a wobble plate type variable displacement compressor will now be described with reference to FIGS. 1 through 4.

A front housing 2 and a rear housing 3 are fixed at opposing sides of a cylinder block 1. A rotary shaft 4 is rotatably supported by a pair of bearings 4*b* in the cylinder block 1 and the front housing 2. A drive plate 5 is secured to the rotary shaft 4. A rotary plate 6 is supported by the drive plate 5. The connection of an elongated hole 5*b* in an arm 5*a* of the drive plate 5 and a pin 7 permits the tilt angle of the rotary plate 6 to vary. The rotary shaft 4 supports a guide sleeve 8 to be slidable, with shaft pins 8*a* protrusively formed at corresponding sides. These shaft pins 8*a* support the rotary plate 6 to be swingable on the rotary shaft 4. A wobble plate 9 is supported to be relatively rotatable on the rotary plate 6.

A plurality of cylinder bores 1*a* (six cylinder bores in this embodiment) are arranged around the rotary shaft 4 at equiangular intervals, and are extended along the axis of the rotary shaft 4. Each cylinder bore 1*a* accommodates a corresponding piston 10A1, 10A2, 10A3, 10A4, 10A5 or 10A6. Each piston 10Aj (j=1 to 6) is connected with the wobble plate 9 via a piston rod 10*a*. The rotating motion of the rotary shaft 4 is converted to the reciprocating motion by way of the drive plate 5 and the rotary plate 6, thus moving the piston 10Aj back and forth in the cylinder bore 1*a*.

A valve plate 11, a valve forming plate 12 and a retainer forming plate 13 are supported between the cylinder block 1 and the rear housing 3. A discharge chamber 3*a* is formed in the rear housing 3. Working chambers P1, P2, P3, P4, P5 and P6 defined within the cylinder bores 1*a* by the pistons 10Aj are partitioned from the discharge chamber 3*a* by the valve plate 11. A discharge port 11*a* is formed in the valve plate 11. A flapper type discharge valve 12*a* and a retainer 13*a* are formed in the valve forming plate 12 and the retainer forming plate 13, respectively. The discharge valve 12*a* executes opening and closing of the discharge port 11*a* on the side of the discharge chamber 3*a*, while the retainer 13*a* restricts bending of the discharge valve 12*a*.

Recesses 1*b* and 3*b* are formed in the center of the facing ends of the cylinder block 1 and the rear housing 3. The distal end of the rotary shaft 4 protrudes into this recess 1*b*. These two recesses 1*b* and 3*b* constitute a cylindrical valve chamber 3A which has a common axis with the rotary shaft 4. A rotary valve 14 is rotatably accommodated in the valve chamber 3A. A thrust bearing 15 is disposed between a bottom surface of the recess 3*b* and the end surface of the rotary valve 14. A coupling 16 is fixedly inserted into the end portion of the rotary valve at the side of the recess 1*b*. A protrusion 4*a* protruding into the recess 1*b* is fixed into the coupling 16. The rotary valve 14 is integrally rotatable with the rotary shaft 4 in the direction designated by an arrow R. A thrust bearing 15 receives a thrust load acting on the rotary valve 14.

In the rotary valve 14 is there formed a suction passage 17 which axially extends from the end surface of the rotary valve at the side of the recess 3*b*, radially extends from almost the center of the valve 14 and opens to the peripheral surface of the valve 14. In the center of the rear housing 3 is there formed an introduction port 3*c* connected with the recess 3*b* through the thrust bearing 15, communicating with an inlet 17*a* of the suction passage 17.

The cylinder block 1 has suction ports 1*cj* (j=1 to 6) as many as the working chambers P1 through P6. Each suction port 1*cj* communicates at its inner end with the valve chamber 3A and extends radially therefrom. The suction ports 1*cj* are arranged at equal angular intervals. The outer end of each suction port 1*cj* communicates with each associated working chamber Pj (j=1 to 6). Each suction port 1*cj* is connected with the outlet 17*b* of the suction passage 17 during the suction stage of the piston.

Figure 2:
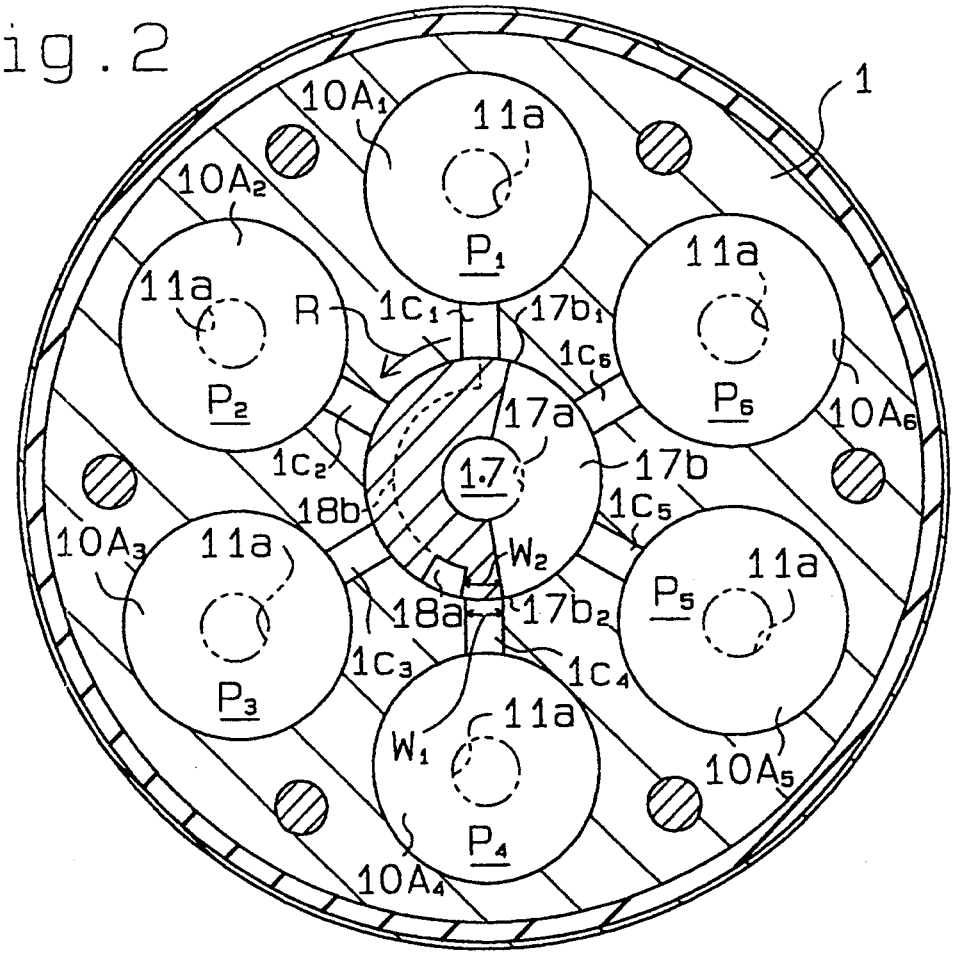
FIG. 2 is a cross sectional view taken along line A—A in FIG. 1.

FIGS. 1 and 2 show that the piston 10A1 is at top dead center, with the piston 10A2 placed by 180° away from the piston 10A1 at bottom dead center. The outlet 17*b*, in this condition, will not be connected with the suction port 1*cl* or 1*c*4. When the piston 10A1 shifts to the suction stage, that is, from top dead center to bottom dead center, the suction passage 17 of the rotary valve 14 communicates with the working chamber P1, and the refrigerant gas supplied through the introduction port 3*c* is sucked into the working chamber P1 via the suction passage 17. The suction of the refrigerant gas is executed likewise in the other working chambers P2 through P6.

Figure 3:
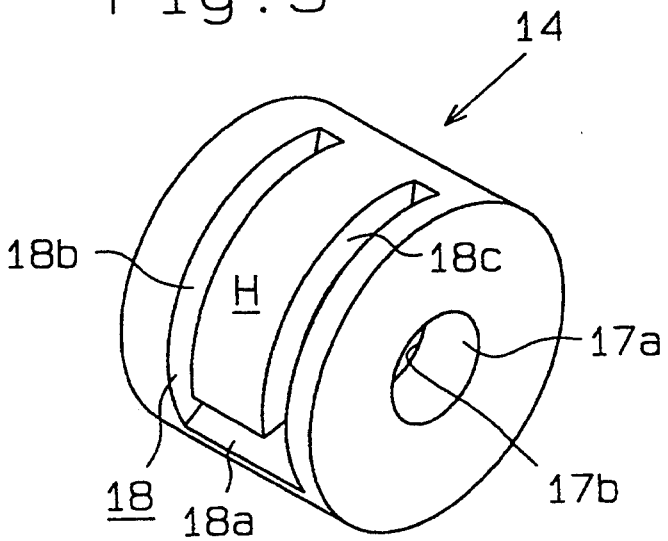
FIG. 3 is a perspective view of a rotary valve in the compressor shown in FIG. 1.

FIG. 3 shows a leak gas catching groove 18 formed on the peripheral surface of the rotary valve 14. The leak gas catching groove 18 comprises an exhaust groove 18*a* extending parallel to the axis of the rotary valve 14, and a pair of gathering grooves 18*b* and 18*c* extending in the hoop direction of the rotary valve 14. The discharge groove 18*a* sequentially communicates with the suction ports 1*cj* as the rotary valve 14 rotates. A seal zone H of the rotary valve 14 surrounded by the leak gas catching groove 18 sequentially closes the suction ports 1*cj* in accordance with the rotation of the rotary valve. When the piston 10*a* shifts from the bottom dead center to the top dead center during its compression stage, the communication between the suction passage 17 and the working chamber Pj is blocked.

The refrigerant gas sucked into the working chamber Pj is discharged out into the discharge chamber 3*a*, while being compressed as the piston moves from the bottom dead center to the top dead center. However, the stroke of the piston, in this embodiment, varies according to the difference in pressure between within the crank chamber 2*a* and within the working chamber Pj. Accordingly, the tilt angle of the wobble plate 9 changes to affect compression volume. The pressure within the crank chamber 2*a* is controlled by supplying the refrigerant gas with its pressure corresponding to the discharge pressure to the crank chamber 2*a*, and discharging the refrigerant gas in the crank chamber 2*a* out into a region applied with the suction pressure by way of a control valve mechanism (not shown).

In a conventional unit using a flapper valve type suction valve, a lubricant increases an adhesive force between the suction valve and its tight contact surface to retard a timing of opening the suction valve. This time delay, suction resistance by the valve with elasticity against the refrigerant gas, and thermal expansion of the refrigerant gas within the suction chamber result in deteriorating volumetric efficiency of the compressor. In the embodiment using the forcibly rotated rotary valve 14, however, exists no problem of the adhesive force resulted from the lubricant oil or suction resistance in the suction valve. In case where a pressure within the working chamber Pj becomes slightly lower than a predetermined pressure, the refrigerant gas flows immediately into the working chamber Pj. Furthermore, since the refrigerant gas flowing from an outside refrigerator circuit into the working chamber passes through the suction passage within the rotary valve relatively far away from the discharge chamber 3, the thermal expansion of the refrigerant gas is minimized. Therefore, volumetric efficiency, in this embodiment using the rotary valve 14, is significantly improved compared with the conventional compressor having the flapper type suction valve.

Figure 4:
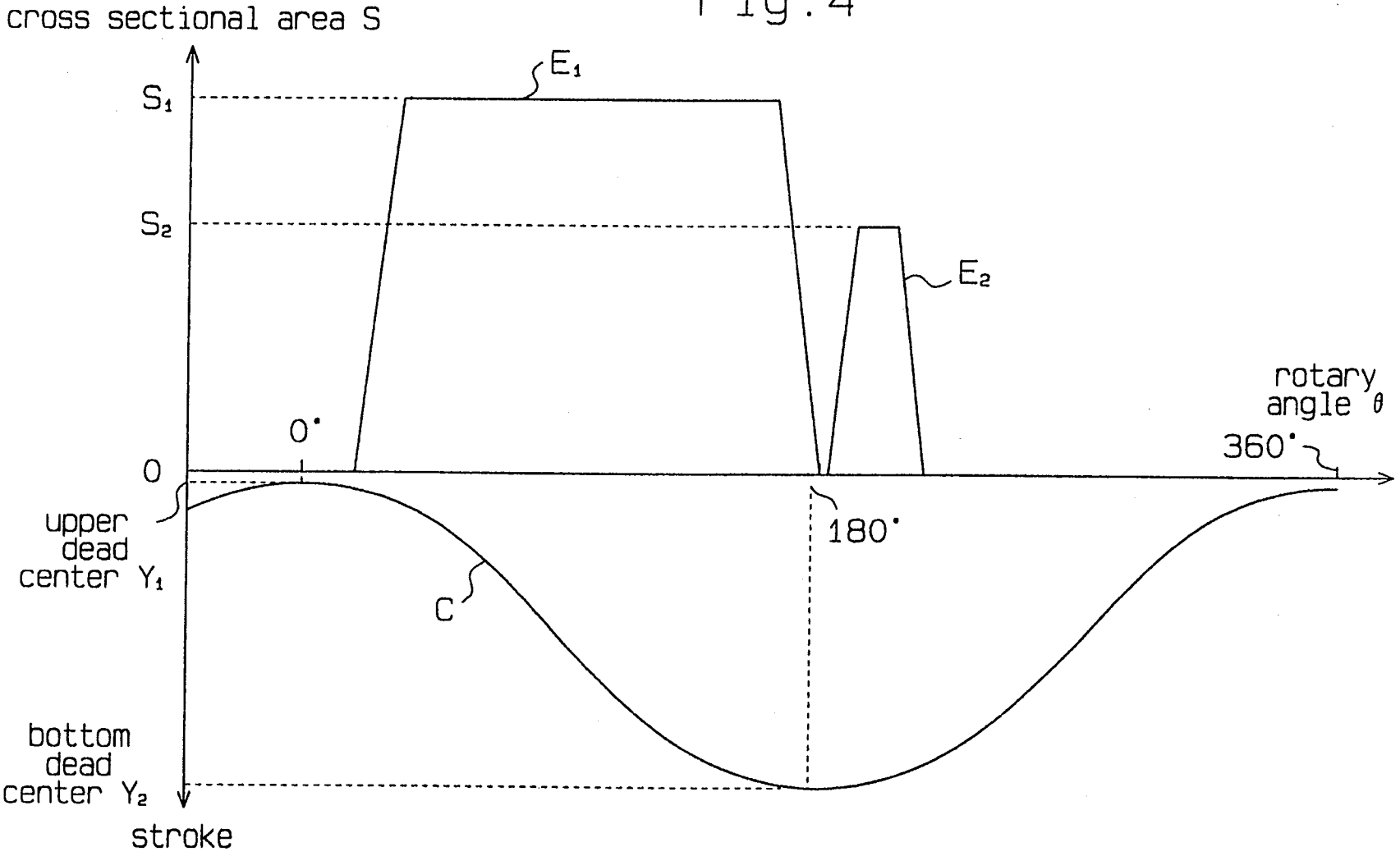
FIG. 4 is a graph illustrating displacement in cross sectional area of a suction port through which a refrigerant gas passes according to the piston stroke of the compressor shown in FIG. 1.

A curve C, in a graph of FIG. 4, expresses a change of stroke of the piston 10Aj, an ordinate expressing a magnitude of the stroke Y. An abscissa designates a rotary angle $\theta$ of the rotary shaft 4. When $\theta$ is 0° or 360°, the piston 10A1 is at its top dead center. When $\theta$ is 180°, the piston 10A1 is at its bottom dead center. The stroke Y is designated with a distance between one end surface of the valve plate 11 and an opposing end surface of the piston 10Aj to the end surface of the valve plate 11.

A curve E1 illustrates displacement in the cross sectional area where the refrigerant gas passes through the suction port 1*cj* with the connection of the suction port 1*j* and the outlet 17*b* of the suction passage. A curve E2 illustrates displacement in the cross sectional area for the refrigerant gas to pass through the suction port 1*cj* when the suction port 1*cj* communicates with the groove 18*a*. The ordinate also shows the cross sectional area S through which the refrigerant gas passes. S1 is a cross sectional area of the suction port 1*cj* through which the refrigerant gas passes, S2 being a cross sectional area for the refrigerant gas in the case where the suction port 1*cj* and the exhaust groove 18 completely overlap. Since the width of the exhaust groove 18 is smaller than the inside diameter of the suction port 1*cj*, when the two overlap, the cross sectional area S2 is smaller than the cross sectional area S1 of the suction port itself.

The rotary angle range of 0° to 180° in the rotary shaft 4 corresponds to the suction stroke with regard to the working chamber P1, while the rotary angle range of 180° to 360° thereof corresponds to the discharge stroke with regard to the working chamber P1. As to the working chamber P4 by 180° apart from the working chamber P1, the rotary angle range of 0° to 180° corresponds to the discharge stroke, the range of 180° to 360° to the suction stroke. Accordingly, the working chambers P2 and P3, in the condition shown in FIG. 2, are in the discharge stroke, on the other hand the working chambers P5 and P6 are in the suction stroke. The working chamber P1 reaches completion of discharging process, while the working chamber P4 reaches completion of suction process.

Hereby attention should be paid to the working chamber P1 which has completed discharge process. As can be seen in FIGS. 2 and 4, while the piston 10A1 associated with the working chamber P1 moves from the top dead center to the bottom dead center, the outlet 17*a* of the suction passage 17 in the rotary valve 14 communicates with the suction port 1*c*1, these two maintain their communication with each other almost during this shifting. Right after the piston 10A1 passes by its bottom dead center, the exhaust groove 18*a* communicates with the suction port 1*c*1.

The gathering grooves 18*b* and 18*c* extend in the hoop direction of the rotary valve 14 from the vicinity of an initiating portion 17*b*1 of the outlet 17*b* to the vicinity of a terminating portion 17*b*2 thereof. The exhaust groove 18*a* is positioned at the vicinity of the terminating portion 17*b*2. W1 in FIG. 2 expresses an angle for the range of formation of the suction port 1*cj* around the rotational axis of the rotary valve 14 (i.e. the rotational axis of the rotary shaft 4), and W2 is an angle between the exhaust groove 18*a* and the terminating portion 17*b*2. The angle W2 is designed to be larger than the angle W1 so that the exhaust groove 18*a* and the outlet 17*b* do not communicate with the suction port 1*cj* at the same time.

The suction ports 1*c*2 and 1*c*3 of the working chambers P2 and P3 during the suction stroke, in the condition shown in FIG. 2, are blocked by the seal region H of the rotary valve 14. A proper clearance is secured between the inner wall of the recesses 1*b*, 3*b* and the peripheral surface of the rotary valve 14 in order to smoothly rotate the rotary valve 14 in the recesses 1*b* and 3*b*. The refrigerant gas with a high pressure will pass through this clearance out to the recesses 1*b*, 3*b*. However, most of the refrigerant gas leaking from the clearance, in this embodiment, goes into the gathering grooves 18*b*, 18*c* and the exhaust groove 18*a* to be securely caught by these grooves, when each suction port is closed.

The exhaust groove 18*a* of the rotary valve 14 is sequentially connected with each suction port 1*cj*. The time for the connection comes immediately after the discharge stroke begins, in other words, directly after the piston passes by its bottom dead center. The exhaust groove 18*a*, in the condition shown in FIG. 2, is positioned just before the suction port 1*c*4 communicating with the working chamber P4 which has just started its discharge stroke. The pressure within the working chamber P4 just after the beginning of discharge stroke is as low as the suction pressure. Accordingly, if the exhaust groove 18*a* communicates with the suction port 1*c*4, the refrigerant gas leaking from the working chambers P2, P3 into the leak gas catching groove 18 flows into the working chamber P4. The refrigerant gas flowed into the working chamber P4 from the groove 18 is discharged out of the working chamber P4 with the refrigerant gas sucked through the suction passages 17.

As described above, the refrigerant gas caught by the leak gas catching groove 18 is sequentially introduced into the working chamber Pj with the rotation of the rotary valve 14. This prevents the refrigerant gas from returning via the accommodating recesses 1*b*, 3*b* to the region, such as the introduction port 3*c*, with the pressure nearly equal to suction pressure, which results in reducing the amount of leaking gas in comparison with the compressor without the leak gas catching groove 18, securing the predetermined amount of the refrigerant gas discharged out of the working chamber Pf, and improving a working efficiency of the compressor.

Figure 5:
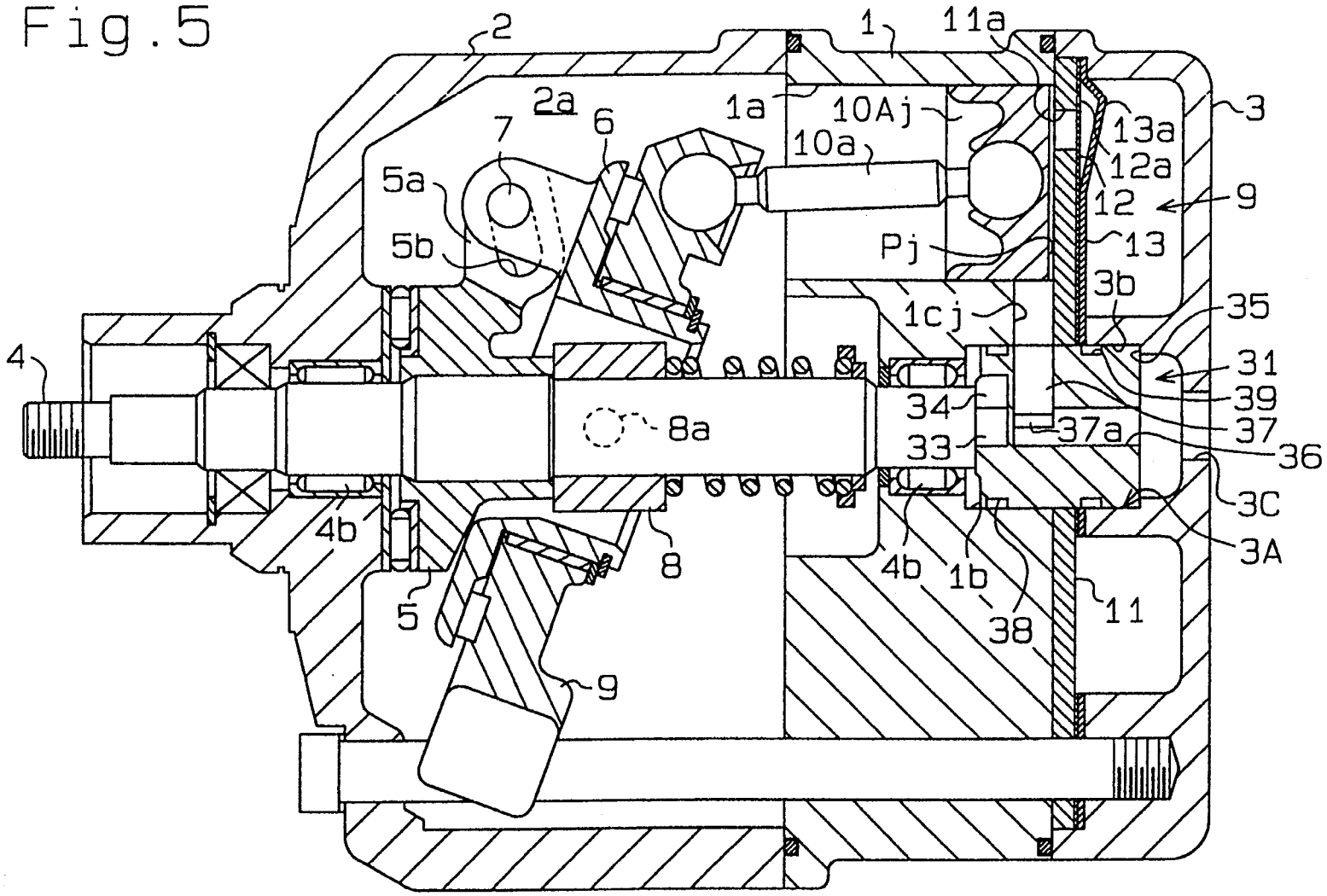
FIG. 5 is a longitudinal sectional view illustrating a wobble plate variable displacement compressor according to a second embodiment of the present invention.
Figure 6:
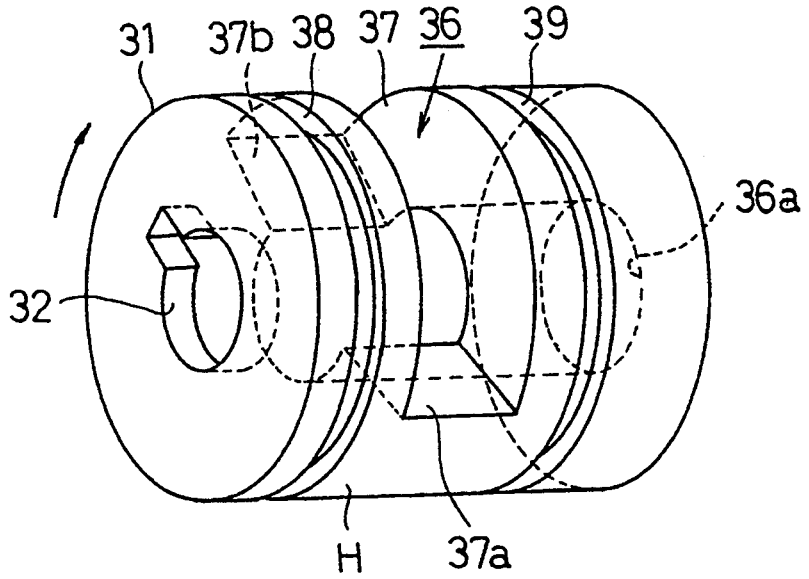
FIG. 6 is a perspective view of a rotary valve in the compressor shown in FIG. 5.
Figure 7:
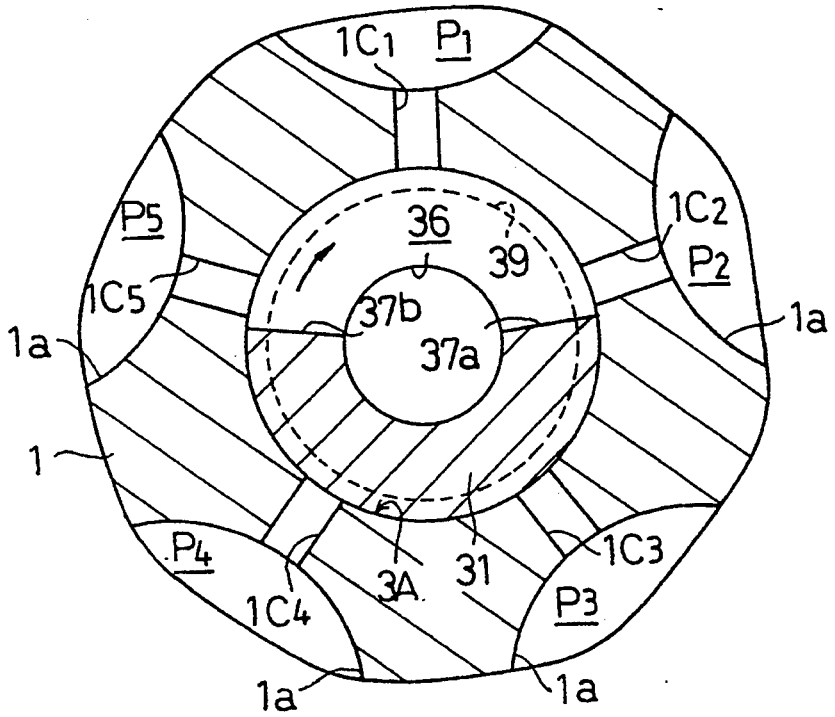
FIG. 7 is a transverse cross sectional view illustrating the rotary valve incorporated in the compressor.

The second embodiment of the present invention will now be described with reference to FIGS. 5 to 7, focusing mainly on the differences between the first and second embodiments. Five bore cylinders 1*a*, in the second embodiment, are equipped, each of which accommodates the associated piston Aj (j=1 to 5). Suction ports 1*cj* (j=1 to 5) are provided in association with each bore cylinder 1*a*, while a connecting hole 32 is formed in the front end of a rotary valve 31 provided in a valve chamber 3A. A connection protrusion 33 formed in the rear end of the rotary shaft 4 is fitted into the connecting hole 32. A key connects the rotary shaft 4 and the rotary valve 31 to be integrally rotatable. A step 35 formed on the inner wall of the valve chamber 3A restricts the rearward movement of the rotary valve 31.

A suction passage 36 communicating with the port 3*c* is formed in the rotary valve 31. This suction passage 36 is provided with an inlet 36*a* formed in a central portion of the rotary valve 36. This suction passage 36 always communicates with the inner end of the inlet 36*a*, opens at the outer peripheral surface of the valve 31, and includes a suction guide groove 37 communicable with the plurality of suction ports 1*cj* in the suction stroke.

When the rotary shaft 4 is rotated, the wobble plate is rocked back and forth via the drive plate 5, the pin 7 and the rotary plate 6 to reciprocate the plurality of pistons 10 Aj with different timing by way of the piston rods 10*a*. On the other hand, as shown in FIG. 7, the initiating portion 37*a* of the suction guide groove 37, positioned ahead in the direction of valve rotation, passes to open the suction ports 1*cj*, when the rotary valve is rotated by the shaft 4 to shift the piston 10Aj into the suction stroke. Consequently, the refrigerant gas is sucked into the working chambers Pj from the inlet 3*c* through the suction port 36 of the rotary valve 31 and the suction ports 1*cj*.

On the completion of the suction stroke, the terminating portion 37*a* of the suction guide groove 37, positioned behind in the direction of valve rotation, passes to close the suction ports 1*cj* to stop the suction of refrigerant gas into the working chambers Pj. Sequentially, the rotary shaft 4 and the rotary valve 31 rotate to shift the pistons 10Aj into its discharge stroke. The refrigerant gas is then compressed within the working chambers Pj, while the suction ports 1*cj* are maintained closed with the outer peripheral surface of the rotary valve 31. The refrigerant gas actuates the discharge valve 12*a* to open the discharge port 11*a*, and then to discharge therefrom out to the discharge chamber 9.

A pair of reservoir grooves 38, 39 are formed at both sides of the suction guide groove 37, extending along the whole outer peripheral surface. Therefore, during the rotation of the rotary valve 31, oil included in the refrigerant gas introduced from the introduction port 3*c* or in the refrigerant gas entering through a clearance with respect to the bearing 4*b* from the crank case 2*a* to the valve chamber 3A, passes through the clearance between the outer peripheral surface and the inner wall of the valve chamber 3A, and goes into reservoir grooves 38 and 39, where the oil is stored. Accordingly, along with improvement in lubrication between the rotary valve 31 and the valve chamber 3A, the rotary valve 31 is prevented from being burnt when the compressor is operated at high speed.

Furthermore, the oil within the reservoir grooves 38, 39 keep the refrigerant gas from leaking through the clearance between the rotary valve 31 and the valve chamber 3A from high pressure space to low pressure space in the compressor in order to provide an efficient seal between the both 31 and 3A.

Figure 8:
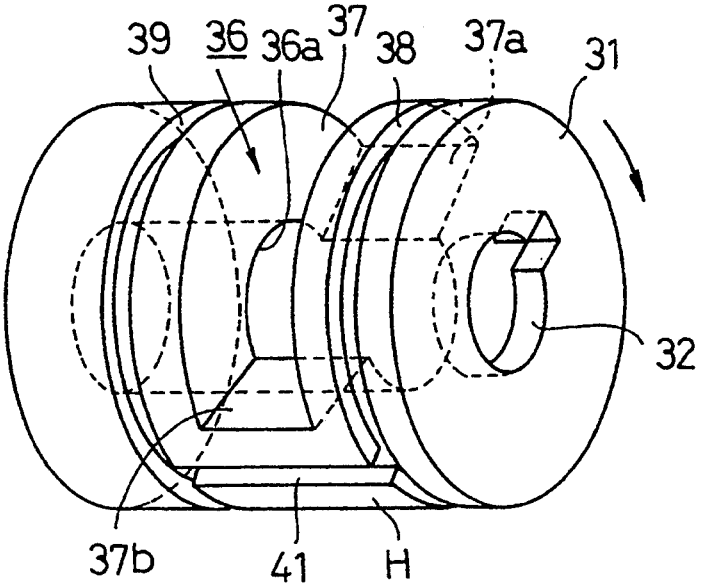
FIG. 8 is a perspective view of the rotary valve according to a third embodiment of the present invention.
Figure 9:
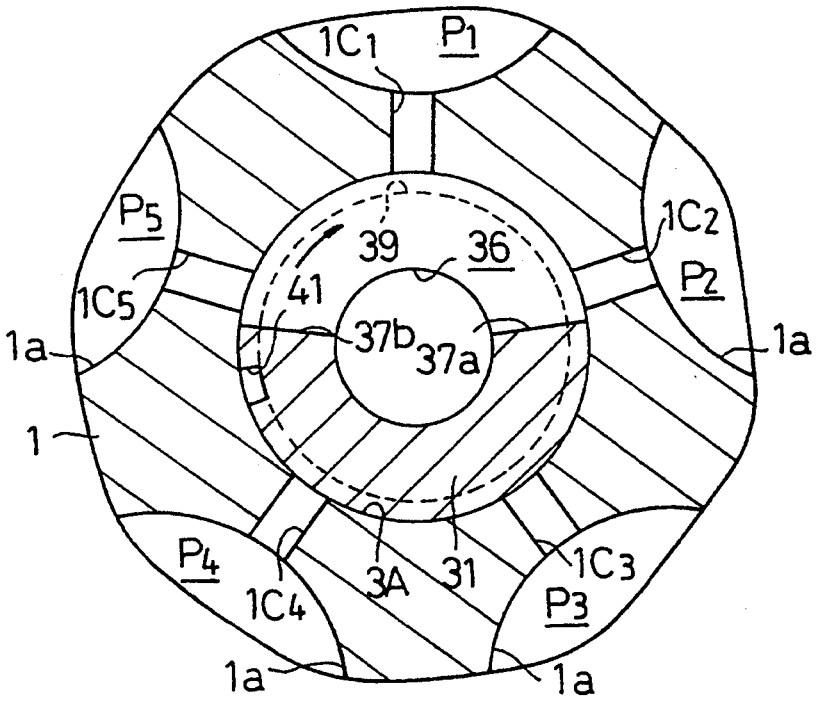
FIG. 9 is a transverse cross sectional view illustrating an assembled structure of the rotary valve in the compressor shown in FIG. 8.
Figure 10:
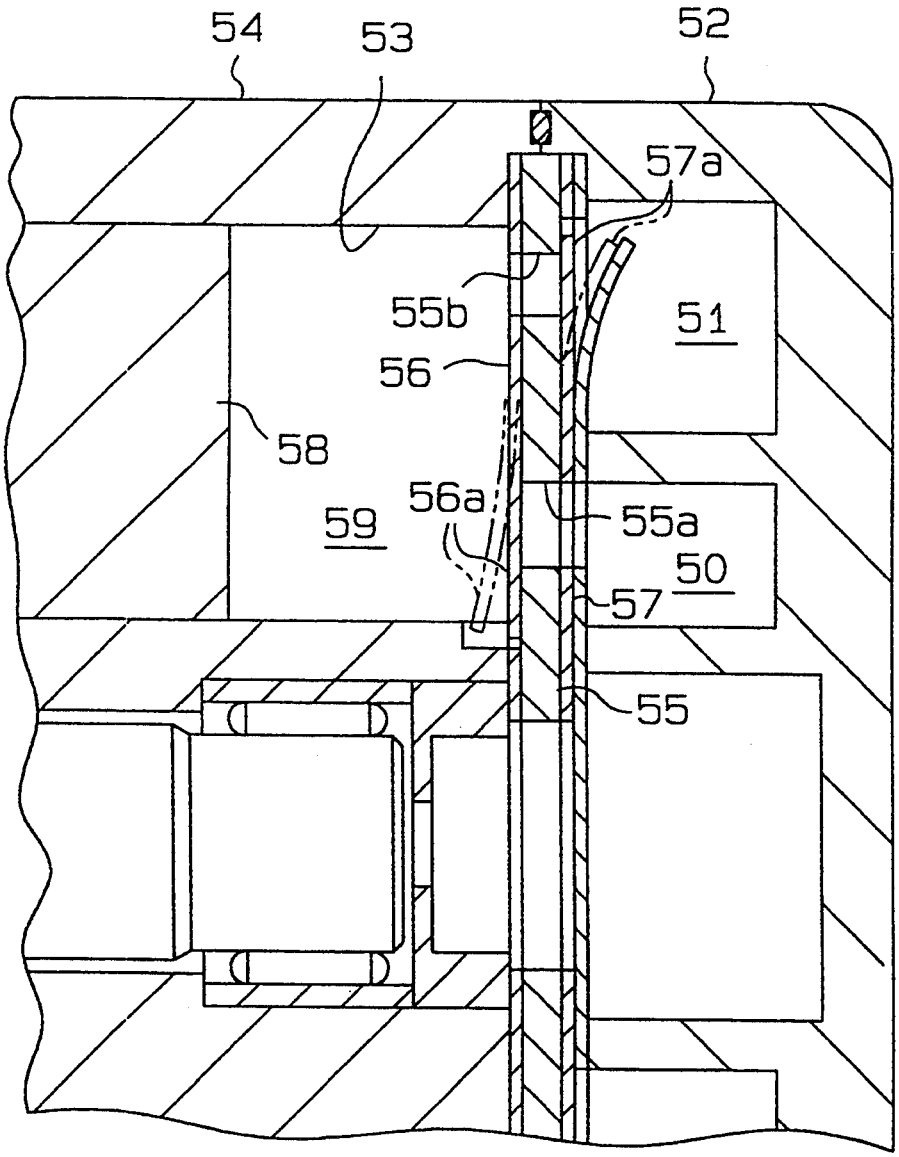
Fig. 10 PRIOR ART
FIG. 10 is a partial sectional view illustrating a refrigerant gas guiding mechanism in a conventional compressor.

A third embodiment of the present invention will now be described referring to FIGS. 8 and 9.

The two reservoir grooves 38 and 39 of the second embodiment communicate with each other by a communication groove 41 in this embodiment. This communication groove 41 is formed in the vicinity of the initiating portion 37*b* of the suction guide groove 37. The remaining structure is the same as that of the second embodiment.

Accordingly, as the rotary valve rotates, the refrigerant gas with a higher pressure than the suction pressure, in this embodiment, is introduced via each of the ports 1*cj* into the communication groove 41 from each of the working chambers Pj which has completed the suction stroke and executes the discharge stroke. The flow of this refrigerant gas into these two reservoir grooves 38, 39 forces out the refrigerant gas and oil, which have previously been stored there, and turn these fluid to the opposite side of the communication groove 41. The fluid presses a part of the outer peripheral surface of the rotary valve 31, even if the part faces to the one of the suction ports 1*cj* in the suction stroke, the part receives the pressure from the fluid in a direction where it is apart from the inner wall of the valve chamber. On the other hand, high pressure is applied to the outer wall of the rotary valve 31 via the suction ports 1*cj* communicating with the working chamber Pj in the compression stroke. These two different pressures cancel each other because they work against the outer peripheral surface of the rotary valve 31 in the opposite directions. Accordingly, the rotary valve is not locally loaded, which will minimize the local wear of it.

The present invention is not limited to the abovedescribed embodiments, but it should be apparent to those skilled in the art that the present invention may be embodied in the following manners:

(1) The width of the reservoir groove 38 or 39 may be changed to be larger as it comes closer to the periphery of the rotary valve 31 on which the suction guide groove is formed. Thus, while the piston is in the suction stroke, the pressure which urges the outer surface of the rotary valve away from the inner wall of the valve chamber 3A will be increased, so that the load applied to the rotary valve is still more equalized.

(2) The reservoir grooves 38, 39 may be discontinuously formed, or a plurality of independent communication grooves 41 provided.

(3) The valve chamber 3A may be equipped either in the cylinder block 1 only or the rear housing 3 alone.

Industrial Applicability

As described above, the refrigerant gas guiding mechanism of the piston type compressor according to the present invention minimizes pressure loss resulting from structure of the suction valve, improves volumetric efficiency of the compressor and has a high sealing ability. Therefore, this can be applied to air conditioners for vehicles or refrigerators.

We claim:

1. A piston type compressor including a plurality of pistons provided in associated cylinder bores arranged around a rotary shaft, each piston reciprocating in response to rotation of the rotary shaft to execute suction, compression and discharge of a refrigerant gas, the compressor having a refrigerant gas guiding mechanism comprising:

a valve chamber disposed in the vicinity of the cylinder bores;

a plurality of ports arranged to interconnect the valve chamber with each of the cylinder bores;

a rotary valve accommodated in the valve chamber and rotatable in relation to reciprocation of the pistons;

a suction passage provided in the rotary valve to be sequentially brought into communication with each of the ports in synchronism with the rotation of the rotary valve in order to introduce the refrigerant gas into each of the cylinder bores;

a seal zone provided in the rotary valve for blocking each of the ports in synchronism with the rotation of the rotary valve; and a groove formed in the outer peripheral surface of the rotary valve capable of catching any fluid entering between the valve chamber and the rotary valve.

2. A refrigerant gas guiding mechanism according to claim 1, wherein the rotary shaft and the rotary valve are arranged coaxially with each other, and their opposing ends are connected with each other so as to be rotated integrally.

3. A refrigerant gas guiding mechanism according to claim 1, wherein the suction passage includes a first portion longitudinally extending from an end surface of the rotary valve toward the center thereof, and a second portion communicating with the first portion, extending radially, and opening to an outer periphery of the rotary valve.

4. A refrigerant gas guiding mechanism according to claim 3, wherein the seal zone is formed on the outer periphery of the rotary valve at an opposing side to the second portion of the suction passage, and the seal zone blocks one of the ports of the cylinder bores during its piston discharge stroke when the second portion of the suction passage is connected to one of the ports of the cylinder bores during its piston suction stroke.

5. A refrigerant gas guiding mechanism according to claim 3, wherein the grooves are located at opposed sides with respect to the seal area.

6. A refrigerant gas guiding mechanism according to claim 5, wherein the grooves are connected to each other by a connecting groove extending in parallel to the longitudinal axis of the rotary valve on the outer periphery thereof, the connecting groove being connectable to one of the ports of the cylinder bores when its piston stroke shifts from the suction stroke to the discharge stroke.

7. A piston type compressor including a plurality of pistons provided in associated cylinder bores arranged around a rotary shaft, each piston reciprocating in response to rotation of the rotary shaft to execute suction, compression and discharge of a refrigerant gas, the compressor having a refrigerant gas guiding mechanism comprising:

a valve chamber disposed in the vicinity of the cylinder bores;

a plurality of ports arranged to interconnect the valve chamber with each of the cylinder bores;

a rotary valve accommodated in the valve chamber and rotatable in relation to reciprocation of the pistons;

a suction passage provided in the rotary valve to be sequentially brought into communication with each of the ports in synchronism with rotation of the rotary valve in order to introduce the refrigerant gas into each of the cylinder bores, the suction passage including a first portion longitudinally extending from an end surface of the rotary valve toward the center thereof, and a second portion in communication with the first portion, extending radially, and opening to an outer periphery of the rotary valve;

a seal zone provided in the rotary valve for blocking each of the ports in synchronism with rotation of the rotary valve; and a pair of grooves formed in the surface of the rotary valve capable of catching any fluid entering between the valve chamber and the rotary valve, said grooves in the surface of the rotary valve being provided at opposed sides with respect to the second portion of the suction passage.

8. A refrigerant gas guiding mechanism according to claim 7, wherein the guide grooves are connected to each other by a connecting groove extending in parallel to an axis of the rotary valve on the outer periphery thereof, the connecting groove is connectable to one of the ports of the cylinder bores when its stroke shifts from the suction stroke to the discharge stroke.

9. A refrigerant gas guiding mechanism according to claim 8, wherein the guide grooves are provided over the outer periphery of the rotary valve.

* * * * *